US005810239A

United States Patent [19]

Stich

[11] Patent Number: 5,810,239

[45] Date of Patent: Sep. 22, 1998

[54] ATTACHMENT FOR NAILING MACHINE

[75] Inventor: Friedrich Stich, Langenlois, Austria

[73] Assignee: The Max Co., Ltd., Tokyo, Japan

[21] Appl. No.: 608,322

[22] Filed: Feb. 28, 1996

[30] Foreign Application Priority Data

Feb. 28, 1995 [JP] Japan ..... 7-64986

[51] Int. Cl.[6] ..... B25C 1/04

[52] U.S. Cl. ..... 227/119; 227/123; 227/147

[58] Field of Search ..... 227/119, 147, 227/123

[56] References Cited

U.S. PATENT DOCUMENTS

| | | | |
|---|---|---|---|
| 1,694,284 | 12/1928 | Santa Ana . | |
| 1,726,012 | 8/1929 | Bilz | 227/147 |
| 2,857,596 | 10/1958 | Allen et al. | 227/123 |
| 3,081,885 | 3/1963 | Carlzen et al. | 227/119 |
| 5,316,200 | 5/1994 | Wallin | 227/119 |
| 5,452,835 | 9/1995 | Shkolnikov | 227/119 |
| 5,476,204 | 12/1995 | Eisenpresser et al. | 227/119 |

FOREIGN PATENT DOCUMENTS

| | | |
|---|---|---|
| 0 038 396 | 10/1981 | European Pat. Off. . |
| 0 547 638 | 6/1993 | European Pat. Off. . |
| 3121111A1 | 9/1982 | Germany . |
| 41 32 504 | 4/1992 | Germany . |
| 683679 | 4/1994 | Switzerland . |
| 1 402 034 | 8/1975 | United Kingdom . |
| 82/00792 | 3/1982 | WIPO . |

*Primary Examiner*—Scott A. Smith
*Attorney, Agent, or Firm*—Morgan, Lewis & Bockius LLP

[57] ABSTRACT

An attachment for a nailing machine in which a nose part drives out a nail having a nail head portion and a nail shaft portion, and in which a driver repeatedly strikes the nail, includes: a holder removably attached to the end of the nose part; nail guide members oppositely disposed on the end of the holder with respect to the center axis of the nose part, each of the nail guide members including, a first guide surface provided on an inner side thereof increasing in diameter in a taper form toward the holder, for guiding the nail head portion driven out from the nose part, a second guide surface provided continuous with the first guide surface, an inner diameter of the second guide surface being the same as or smaller than the diameter of the nail shaft portion, wherein the entire circumferential surfaces of the nail head portion and the nail shaft portion are guided by the first and second guide surfaces, and an outer surface tapered such that the outer surface narrows toward the end edge of the second guide surface; pivot shafts provided perpendicular to the center axis of the nose part, the pivot shafts open/closably supporting the respective nail guide members; and urging device for urging the nail guide members toward the center axis of the nose part.

8 Claims, 6 Drawing Sheets

ATTACHMENT FOR NAILING MACHINE

BACKGROUND OF THE INVENTION

This invention relates to a nailing machine attachment removably attached to the end of a nose part of a nailing machine which makes possible aim-driving of nails.

Generally, in the 2×4 engineering method and the like, when wooden members are to be joined as in the case of joining a beam and a joist at a right angle, a metal fitting 30 of the kind shown in FIG. 7 is used. Numerous nail holes 31 are provided in the metal fitting 30, and the wooden members 32 and 33 are fixed together with the metal fitting 30 by driving nails through these nail holes 31. Because normally numerous nails are used at each joint, the number of nail driving in the work as a whole is extremely large. Furthermore, because strength is required of joints between structural members such as beams, fat, long nails are used. Also, because relatively hard wood is used for structural members, great power is necessary in a nailing machine. Because of this, recently, by continuously striking each nail numerous times it has become possible to drive fat, long nails into relatively hard material even with a relatively small nailing machine.

However, because normally constitutional members of a safety device are disposed on the end of the nose part which drives out the nails, it is not possible to directly see the location into which the nails are driven out. As a result, with a conventional nailing machine it is quite difficult to accurately drive nails into nail holes in a metal fitting. Furthermore, because the tip of the nail moves freely in the injection hole for nail driving-out which is of an internal diameter corresponding to the head portion diameter of the nail, even if the end of the nose part is aligned with a nail hole, the nail does not necessarily enter the nail hole.

Also, sometimes the reaction of the nail driving force of the nailing machine causes the nailing machine to move in the opposite direction to the driving direction, and in this case the driver for nail driving-in misses the nail head portion and striking failure occurs. This phenomenon, when driving nails horizontally into a vertical work surface, the weight of the nailing machine acts in the gravitational direction and a state wherein the nail head portion slips downward from the nose part often occurs.

Also, because in ordinary nailing machines there has been the problem that because the end portion of the nose part is cylindrical it is impossible to aim-drive into nail holes close to the bend portion of the metal fitting.

In this connection, as this kind of aim-driving mechanism, as disclosed in Japanese Utility Model Application Laid-open No. Sho. 48-34981, those having a hole-aiming guide mounted on the end of the nose part are known. However, because this guide only guides two sides of the nail, it cannot prevent the nail from flying out in a direction perpendicular to the two guides.

SUMMARY OF THE INVENTION

An object of this invention is to provide a safe attachment for a nailing machine which solves the above-mentioned shortcomings and with which it is possible to aim-drive easily and accurately particularly in narrowly limited locations and there is little flying-out of nails when mis-driven.

In order to achieve the object, there is provided an attachment for a nailing machine in which a nose part drives out a nail having a nail head portion and a nail shaft portion, and in which a driver repeatedly strikes the nail, the attachment comprising: a holder removably attached to the end of the nose part; nail guide members oppositely disposed on the end of the holder with respect to the center axis of the nose part, each of the nail guide members including, a first guide surface provided on an inner side thereof increasing in diameter in a taper form toward the holder, for guiding the nail head portion driven out from the nose part, a second guide surface provided continuous with the first guide surface, an inner diameter of the second guide surface being the same as or smaller than the diameter of the nail shaft portion, wherein the entire circumferential surfaces of the nail head portion and the nail shaft portion are guided by the first and second guide surfaces, and an outer surface tapered such that the outer surface narrows toward the end edge of the second guide surface; pivot shafts provided perpendicular to the center axis of the nose part, said pivot shafts open/closably supporting the respective nail guide members; and urging means for urging the nail guide members toward the center axis of the nose part.

Preferably, the two nail guide members are provided with the attachment.

Furthermore, the attachment for a nailing machine thus constructed, wherein the pivot shafts are mounted parallel to an extension direction line of a grip portion of the nailing machine, and parts of the outer surface of each guide member are formed with flat exterior shapes cut on planes perpendicular to the pivot shafts.

According to the invention, when the tip of the pointed guide members is brought into abutment with a member to be nailed and the nailing machine is started, a nail inside the nose part is struck and the nail shaft portion is guided by the first guide surface and the second guide surface and driven out from the end of the guide members. Further, the nail head portion is guided by the first guide surface of the guide members while driven. Because the diameter of the first guide surface enlarges in taper form, the guide members are pushed apart by the nail head portion; however, because correspondingly the spring force acts on the first guide surface more strongly, the nail head portion is strongly guided. Finally when the nail head portion emerges from the guide members, nail driving-in ends.

As a result, according to the invention, because the outer circumferential surfaces of the guide members of the attachment are so tapered that they narrow toward the end edge of the second guide surface, nails can be easily and accurately aim-driven into narrowly limited locations.

Also, because the entire circumferential surfaces of the nail head portion and the nail shaft portion are guided by the first guide surface and the second guide surface, as well as it being possible to aim-drive with certainty, by making the spring forces of the helical springs which urge the guide members in the closing direction strong, the guide members simply opening is suppressed, and even when mis-driving occurs, because the nail can be held inside the guide members so that the nail does not fly out to outside, it is safe, and also the driven driver failing to hit the nail head portion and the nail consequently being bent is well prevented.

Furthermore, because the end of the guide members is tapered and flat, by slightly inclining the nailing machine it is possible to easily and accurately aim-drive even in corner-driving such as when driving a nail into a nail hole near a right-angle bend portion of a metal fitting. In this case, the guide members open as the head of the nail passes through the guide members, but by making the opening direction parallel with the wall of the above-mentioned bend portion the guide members abutting with the bend portion can be avoided.

DETAILED DESCRIPTION OF THE PREFERRED EMBODIMENTS

Figure 1:
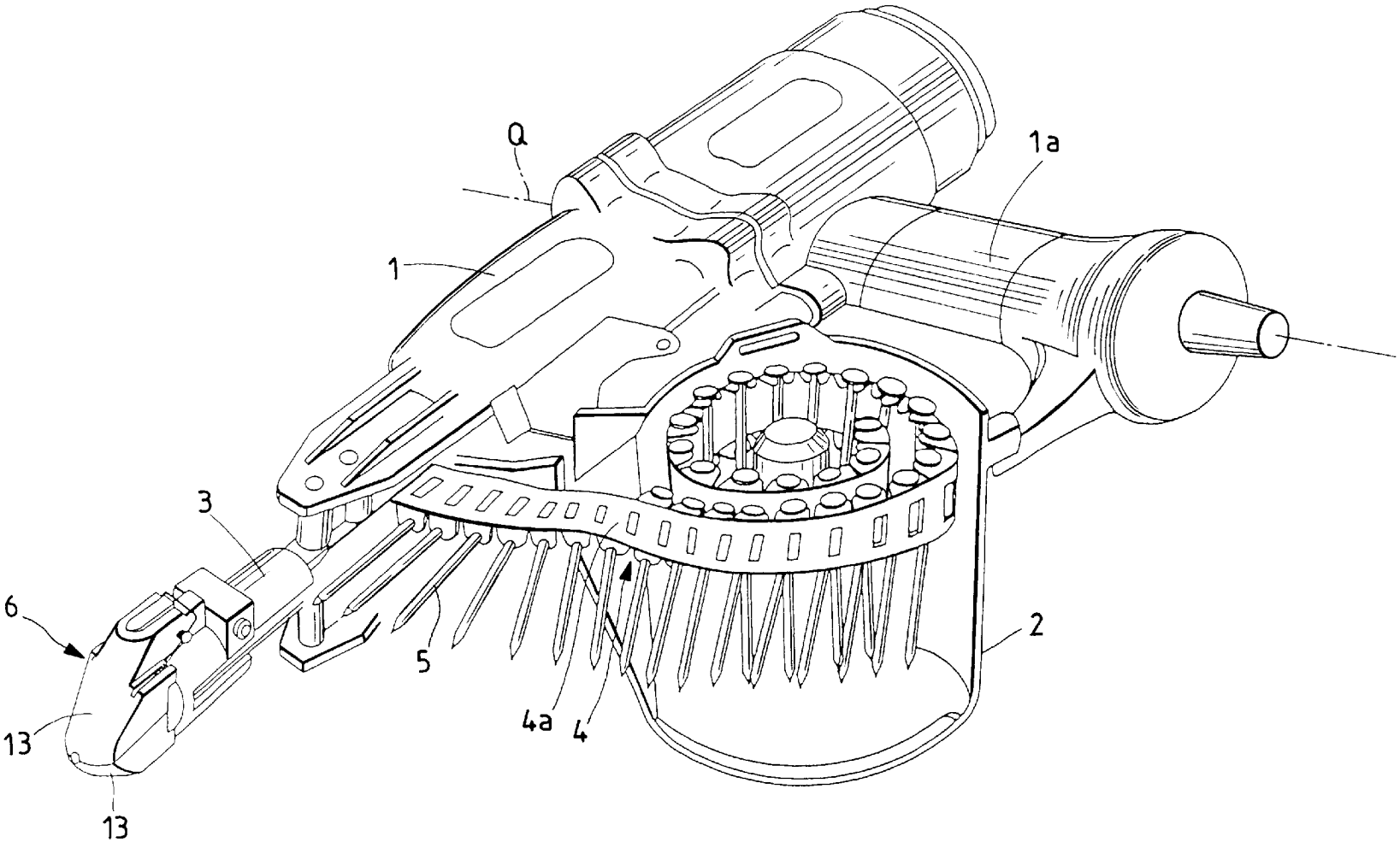
FIG. 1 is a perspective view of a nailing machine fitted with an attachment according to the invention.

FIG. 1 shows a continuous-strike-type nailing machine; this nailing machine is one which for one nail by means of compressed air continuously repeatedly strikes a nail fed by a driver mounted inside a body 1 (shown in FIG. 6) from a magazine 2 into a nose part 3 for nail driving-out and drives it into a material to be nailed, and the nailing mechanism may for example be the same as that disclosed in Japanese Utility Model Publication No. Hei. 5-46854. This kind of nailing machine is usually used when driving-in long nails. The nails used with this nailing machine are formed of a connected nail 4; the connected nail 4 includes numerous nails 5 connected to a connecting belt 4*a* and are loaded in wound form into the magazine 2 and sequentially fed into the nose part 3.

Figure 2:
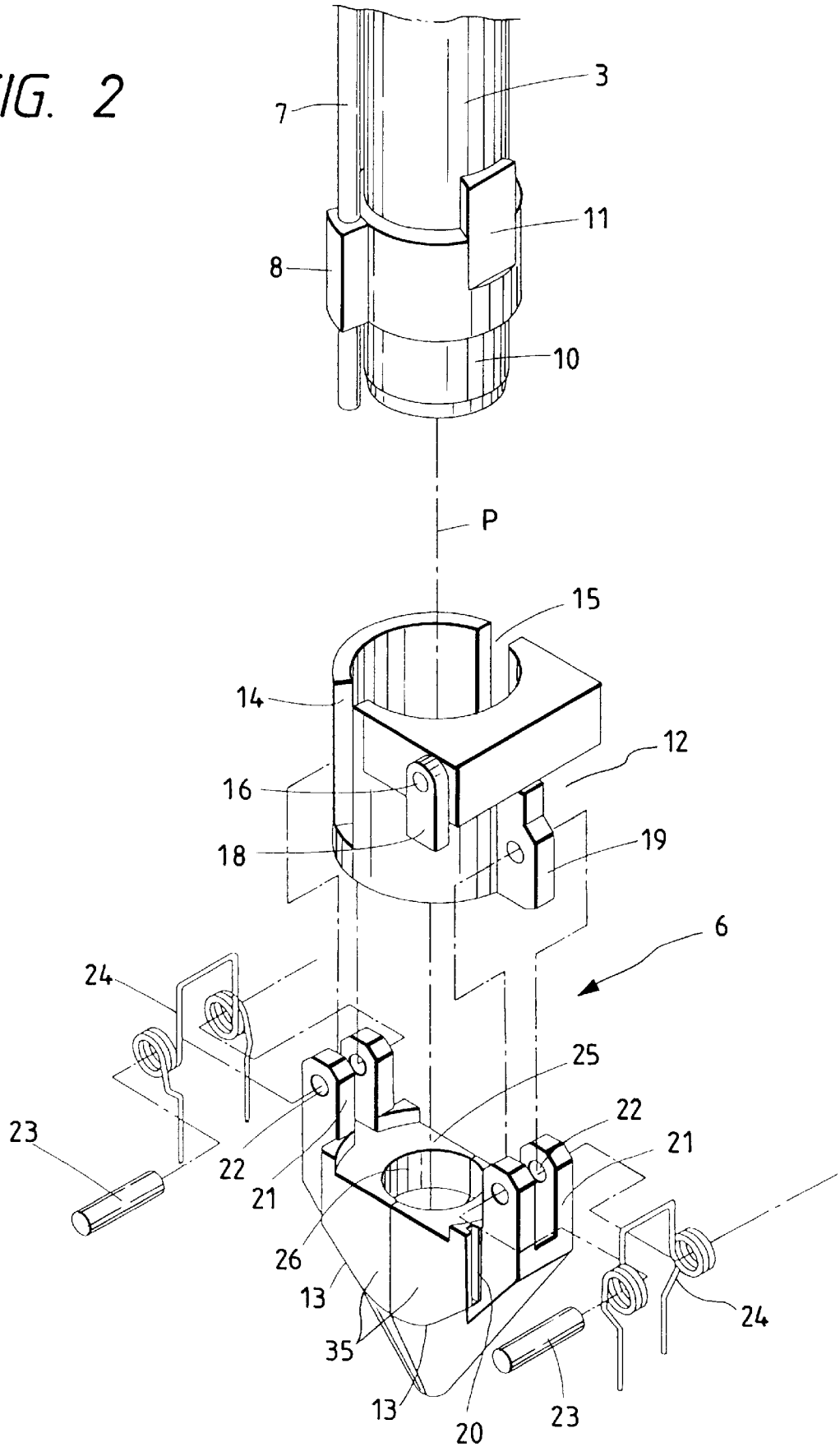
FIG. 2 is an exploded view of the attachment and a nose part.

The nose part 3 is formed at the end of the nailing machine, and an attachment 6 for aim-driving is mounted on this nose part 3. As shown in FIG. 2, a guide protrusion 8 for a contact rod 7 is formed on a portion of the circumferential surface of the nose part 3. The contact rod 7 is mounted on the body 1 relatively movably in the nail driving direction and is at all times so spring-urged that is projects from the end, and when it is pushed in against the spring-urging it renders operative a trigger mechanism which starts the nailing machine. These construction correspond to a safety device as 'the contact member 9' in the above-mentioned publication. A small outer diameter portion 10 is formed at the end of the nose part 3. An attachment mounting groove 11 having a flat base portion is formed on another portion of the nose part 3.

As shown in FIG. 2 to FIG. 5, the attachment 6 includes a holder 12 removably attached to the nose part 3 and a pair of guide members 13 open/closably mounted on the end of the holder 12 which guide driven-out nails.

Figure 3:
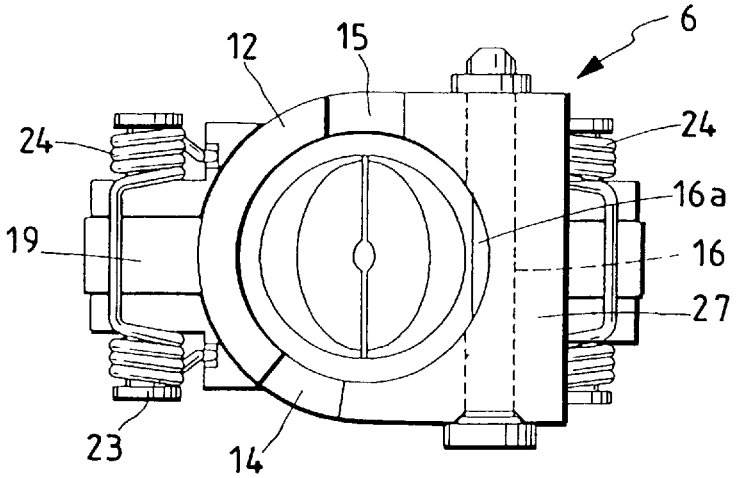
FIG. 3 is a plan view of the attachment.
Figure 4:
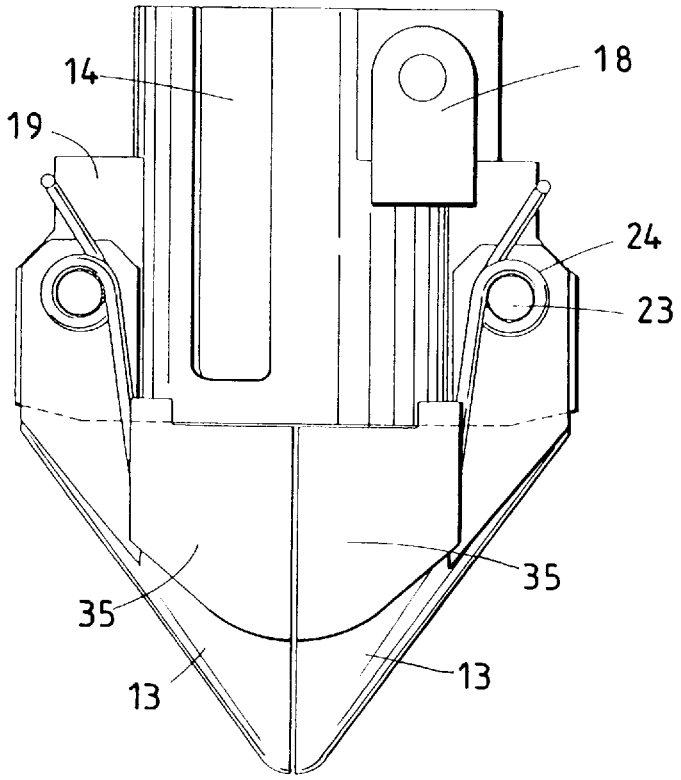
FIG. 4 is a front view of the attachment.
Figure 5:
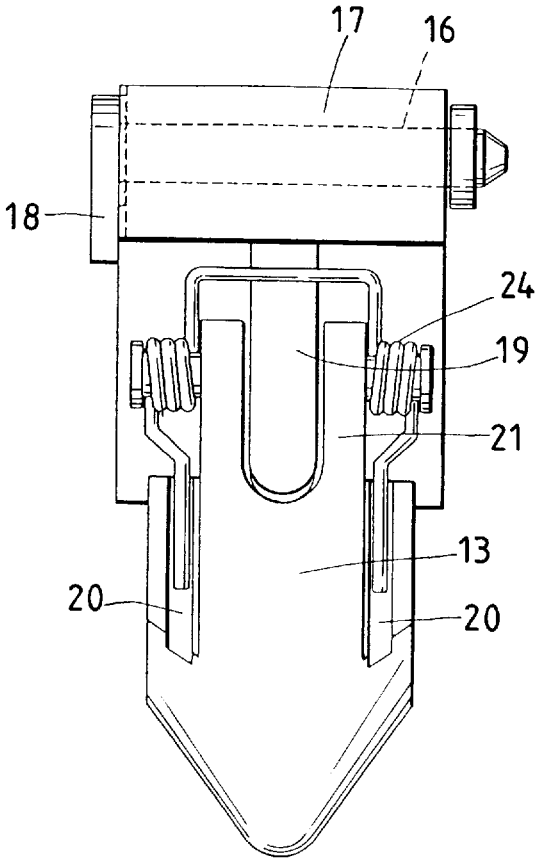
FIG. 5 is a side view of the attachment.

The holder 12 is cylindrical and of such a size that it can fit onto the nose part 3. In the holder 12, a cutaway groove 14 for receiving the end of the contact rod 7 and the guide protrusion 8 is provided in one of two mutually facing side walls and a cutaway groove 15 for receiving the connected nails 4 is provided in the other side wall. Also, a mounting shaft bearing portion 17 for a mounting shaft body 16 is provided at one of the open ends of the holder 12. The central portion of this shaft bearing portion 17 has an opening in the inner surface of the holder 12, and the central portion 16*a* of the mounting shaft body 16 is semicircular in cross-section. A lever 18 for rotating the mounting shaft body 16 is mounted at one end of the mounting shaft body 16, and turning of the lever 18 causes the central portion 16*a* to project into and withdraw from the holder 12 (FIG. 3 shows the projecting state). Also, link projections 19 are provided in opposite positions at the other open end of the holder 12, and spring receiving grooves 20 are provided on both sides of each of these.

Linking slots 21 corresponding to the link projections 19 of the holder 12 are provided projecting on the holder 12 side on mutually facing sides of the bases of the guide members 13. By the link projections 19 of the holder 12 being fitted into the linking slots 21 and pivot shafts 23 being fitted through shaft bearing holes 22 in the linking slots 21, the pair of guide members 13 are disposed facing each other at the end of the holder 12 and mounted with their ends open/closable about the pivot shafts 23. The pivot shafts 23 are mounted parallel with an extension direction Q (see FIG. 1) of a grip la of the nailing machine. Double helical springs 24 are wound on the pivot shafts 23, and the ends of the helical springs 24 engage with the spring receiving grooves 20. As a result, the guide members 13 are at all times urged in the closing direction (radially inward, toward the center axis P of the nose part 3). The helical springs 24 have large spring forces.

Figure 6A:
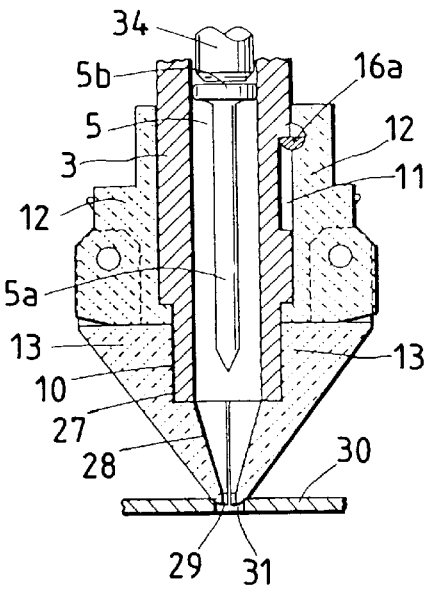
FIGS. 6(*a*), 6(*b*), 6(*c*) are views illustrating nail driving-in states.
Figure 6B:
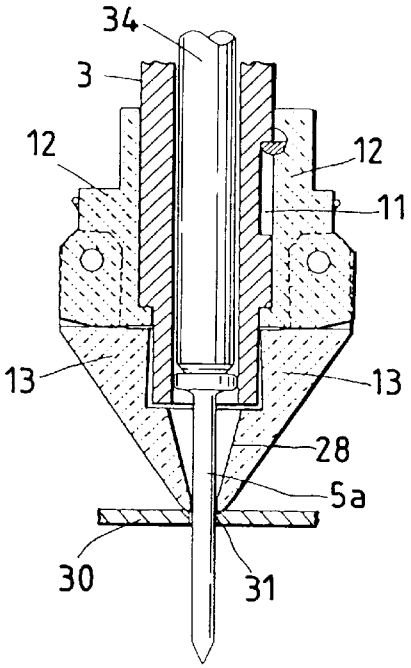
Figure 6C:
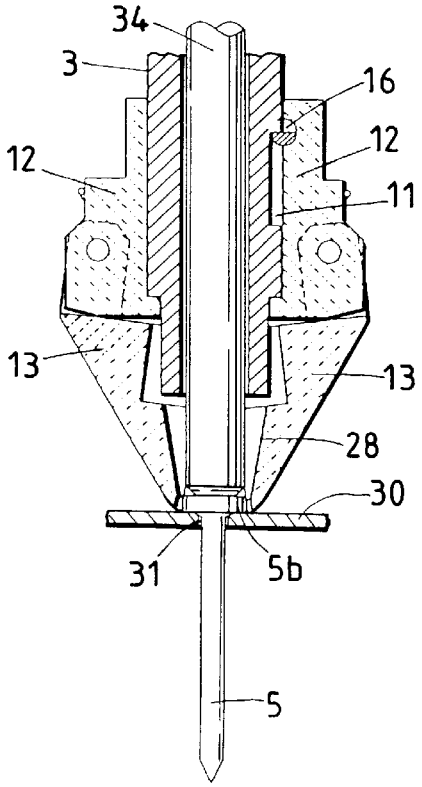

A receiving surface 25 for receiving the end surface of the holder 12 is provided on the bases of the guide members 13, and a fitting hole 26 for the nose part 3 to fit into is provided in the center of the receiving surface 25. The inner sides of the guide members 13 are shaved. As shown in FIG. 6(*a*), continuous with the fitting hole 26 a receiving portion 27 for receiving a small diameter portion 10 of the nose part 3 is provided, a first guide surface 28 increasing in diameter in a taper form for guiding a nail head portion 5*b* is further provided, and then a second guide surface 29 of inner diameter smaller than (or the same as) the diameter of the nail shaft portion 5*a* is provided continuous with the end of the first guide surface 28. The guide surfaces 28 and 29 of the two guide members 13 when they are closed are so continuous around the center axis of the holder 12 and as a whole form a beak shape that they guide the entire circumferential surface of the nail head portion 5*b* and the nail shaft portion 5*a*. The outer circumferential surface of the end is of taper form narrowing toward the end edge of the second guide surface 29. The respective base portion sides of the outer circumferential surfaces are provided with cut surfaces 35 formed by cutting on planes perpendicular to the axes of the pivot shafts 23 so that as a whole their exterior shapes are flat.

When the attachment 6 of the above constitution is to be attached to the nose part 3, after the central portion 16*a* of the mounting shaft body 16 is withdrawn by rotating the lever 18, the end of the nose part 3 is inserted into the holder 12 and fitted in until the end surface of the small diameter portion 10 at the end thereof abuts with the receiving portion 27. At this time, the contact rod 7 and its guide protrusion 8 are received by the cutaway groove 14. The other cutaway groove 15 is disposed in a position facing the magazine 2 side so that the connected nails 4 can be fed into the nose part 3. By turning the lever 18 reversely, the central portion 16*a* of the mounting shaft body 16 engages with the inside of the attachment mounting groove 11 of the nose part 3, the attachment 6 is attached slidably within the range of the attachment mounting groove 11 along the center axis of the nose part 3, and normally the attachment 6 is also urged in the projecting direction by the spring which urges the contact rod 7. The guide members 13 are oppositely disposed symmetrically sandwiching the center axis P of the nose part 3. When the attachment 6 is to be removed, this is done by rotating the lever 18.

Figure 7:
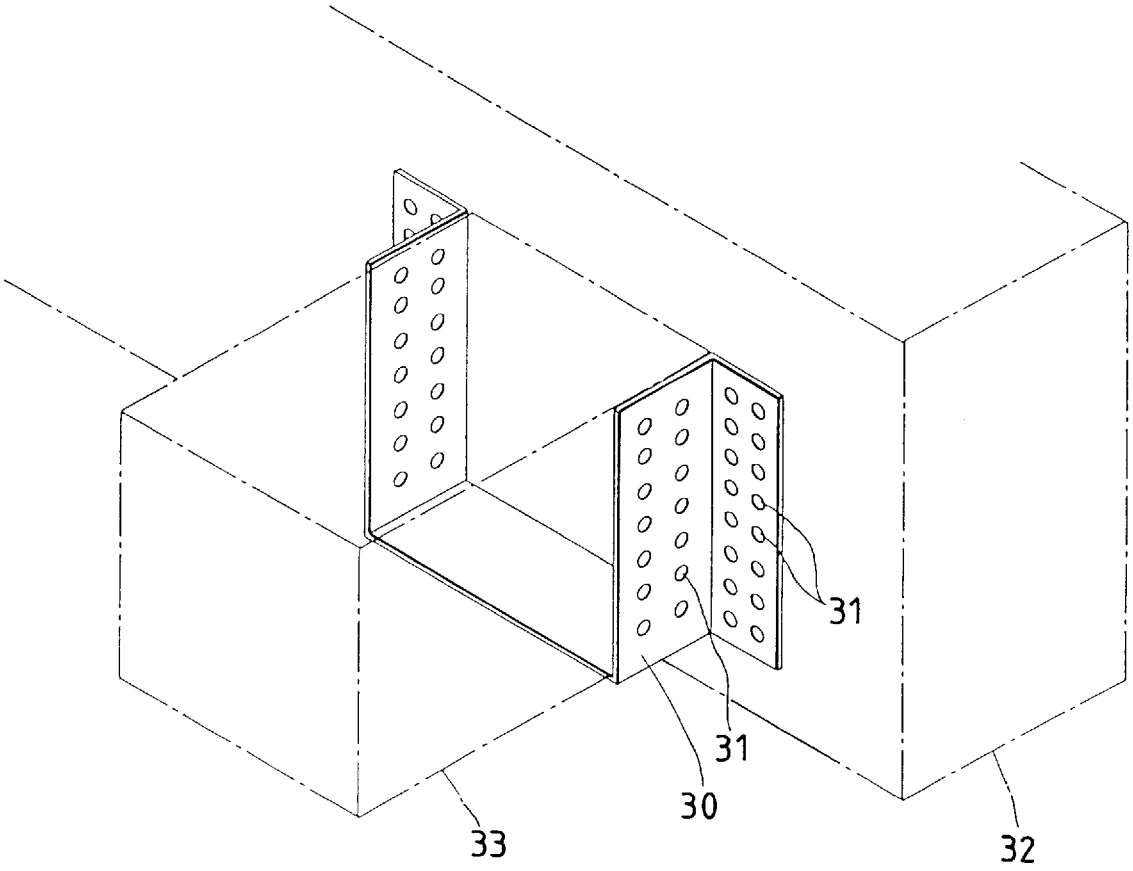
FIG. 7 is a view illustrating a structural member joint.

Here, an example in which a nail is aim-driven into a nail hole 31 in the metal fitting 30 shown in FIG. 7 with a nailing machine fitted with the attachment 6 will be described. First, the nose part 3 is aimed at a nail hole 31 as shown in FIG. 6(*a*), and the pointed end of the guide members 13 is caused to engage with the inside of the nail hole 31. By pushing the nose part 3 against the metal fitting 30 the contact rod 7 together with the attachment 6 is pushed against the resistance of the spring urging and makes the trigger mechanism operative. By pulling the trigger lever 18 the nailing machine is started, and the nail inside the nose part 3 is continuously repeatedly struck by the driver 34. First, the end of the nail is guided by the first guide surface 28 and the second guide surface 29 of the guide members 13 and enters the nail hole 31 in the metal fitting 30 through the end of the guide members 13 as shown in FIG. 6(*b*). When the nail shaft portion 5*a* emerges from the end of the guide members 13, because the guide members 13 are pushed apart by the nail shaft portion 5*a*, they open against the spring forces of the helical springs 24 and withdraw from the nail hole 31; however, the nail shaft portion 5*a* continues to be guided by the above-mentioned spring forces. Also, the nail head portion 5*b* is driven guided by the first guide surface 28 of the guide members 13. Because the diameter of the first guide surface 28 increases in taper form, the guide members 13 are pushed apart by the nail head portion 5*b* as shown in FIG. 6(*c*), but correspondingly the spring forces of the helical springs 24 act on the first guide surface 28 more strongly, and as a result the nail head portion 5*b* is strongly guided. Finally the nail head portion 5*b* abuts with the metal fitting 30 and stops, and the nail driving-in ends.

When after the nail is driven in the guide members 13 are pulled away from the nail hole 31, the guide members 13 together with the contact rod 7 return to their projecting position again and the next nail driving-in is prepared for.

As described above, in nail driving-in work, because the outer circumferential surfaces of the guide members 13 of the attachment 6 are so tapered that they narrow toward the end edge of the second guide surface 29, nails can be easily and accurately aim-driven into narrowly limited locations.

Also, because the entire circumferential surfaces of the nail head portion 5*b* and the nail shaft portion 5*a* are guided by the first guide surface 28 and the second guide surface 29, as well it being possible to aim-drive with certainty, by making the spring forces of the helical springs 24 which urge the guide members 13 in the closing direction strong, for example even in cases such as when a nail is driven in at a location other than a nail hole 31 in the metal fitting 30, because opening of the guide members 13 is suppressed and the nail can be held inside the guide members 13 so that the nail does not fly out to outside, it is safe, and also the driver failing to hit the nail head portion 5*b* square and the nail consequently being bent is prevented.

Furthermore, because the end of the guide members 13 is tapered and flat, by slightly inclining the nailing machine it is possible to easily and accurately aim and drive a nail in restricted areas, such as comers. For example, the invention allows the operator to drive a nail into a nail hole 31*a* near the right-angle bend portion of the metal fitting 30 as shown in FIG. 7. In this case, the guide members 13 open as the head of the nail passes through the guide members 13, but by making the opening direction parallel with the above-mentioned bend portion the guide members 13 abutting with the bend portion corresponding to the driving-in surface can be avoided.

In this embodiment, the two guide members 13 are provided with attachment for the continuous-strike-type nailing machine. Therefore, when the nailing machine is used horizontally, the driver can prevent from missing to strike the nail head portion.

The attachment 6 is not necessarily limited to being attached to a continuous-strike-type nailing machine. It may also be attached to a single-strike-type nailing machine.

Also, the guide members 13 are not limited to two. There may be three or more.

What is claimed is:

1. An attachment for a nailing machine in which a nose part drives out a nail having a nail head portion and a nail shaft portion, and in which a driver repeatedly strikes the nail into a workpiece, the attachment comprising:

a holder removably attached to the end of the nose part having a projection, the projection including a projection aperture; and nail guide members oppositely disposed on one end of the holder with respect to a center axis of the nose part, each of the nail guide members including, a first guide surface provided on an inner side thereof increasing in diameter in a taper form toward the holder, for guiding the nail head portion driven out from the nose part, a second guide surface provided continuous with the first guide surface, an inner diameter of the second guide surface being the same as or smaller than the diameter of the nail shaft portion, wherein the circumferential surfaces of the nail head portion and the nail shaft portion are guided by the first and second guide surfaces, and an outer surface tapered such that the outer surface narrows toward the end edge of the second guide surface;

an upper portion having an upper aperture;

at least one pivot shaft provided perpendicular to the center axis of the nose part, said pivot shaft disposed in, and aligning the upper portion aperture and the projection aperture thereby allowing the respective nail guide members to pivot with respect to the holder; and a spring disposed concentrically about the pivot shaft and biasing at least one of the nail guide members radially inward.

2. The attachment for a nailing machine according to claim 1, wherein the nail guide members contact with the nail while the nailing machine repeatedly strikes the nail.

3. The attachment for a nailing machine according to claim 2, wherein the pivots shafts are mounted parallel to a grip portion of the nailing machine, and portions of the outer surface of each guide member are formed flat surfaces.

4. The attachment for a nailing machine according to claim 2, further comprising:

a lever rotatably attached to the holder; and a mounting shaft body connecting to the lever, the mounting shaft body having a semicircular portion, wherein the semicircular portion of the mounting shaft body is selectively projected into the holder by rotating the lever for locking the holder to the nose part.

5. The attachment for a nailing machine according to claim 2, wherein each of the nail guide members includes a bracket having a hole into which the pivot shaft is inserted.

6. The attachment for a nailing machine according to claim 2, wherein the nail guide members are biased radially inward towards the center axis of the nose part.

7. The attachment for a nailing machine according to claim 1, wherein the helical spring includes first and second coils, the first coil disposed about a first end of the pivot shaft and the second coil disposed about the second end of the pivot shaft, wherein the upper portion of the guide member and the projection are both disposed between the first and second coils.

8. The attachment for a nailing machine according to claim 1, wherein the helical spring includes an upper portion and a lower portion, the upper portion engaging the holder, and the lower portion engaging the guide member, the guide member further comprising a spring receiving groove to receive the lower portion of the spring.

* * * * *